US011725605B2

(12) United States Patent
Chan et al.

(10) Patent No.: US 11,725,605 B2
(45) Date of Patent: Aug. 15, 2023

(54) CYLINDER HEAD BOLT BOSS CUTOUTS

(71) Applicant: Cummins Inc., Columbus, IN (US)

(72) Inventors: Dennis King Chan, Bloomington, IN (US); William Ryan Dougherty, Sellersburg, IN (US); Jeffrey D. Jones, Columbus, IN (US); Andrew P. Perr, Columbus, IN (US); Andrew Guy Kitchen, Daventry (GB); Philipe F. Saad, Columbus, IN (US); Akintomide K. Akinola, Whiteland, IN (US); Rick Vaughan Lewis, Jr., Franklin, IN (US)

(73) Assignee: CUMMINS INC., Columbus, IN (US)

( * ) Notice: Subject to any disclaimer, the term of this patent is extended or adjusted under 35 U.S.C. 154(b) by 0 days.

(21) Appl. No.: 17/803,486

(22) Filed: Jul. 28, 2022

(65) Prior Publication Data

US 2023/0089814 A1 Mar. 23, 2023

Related U.S. Application Data

(63) Continuation of application No. 16/614,223, filed as application No. PCT/US2017/032694 on May 15, 2017, now abandoned.

(51) Int. Cl.
*F02F 1/42* (2006.01)
*F02F 7/00* (2006.01)
(Continued)

(52) U.S. Cl.
CPC ..... *F02F 7/0021* (2013.01); *F02F 1/24* (2013.01); *F02F 11/002* (2013.01); *F02F 2007/0041* (2013.01)

(58) Field of Classification Search
CPC ..... F02F 1/40; F02F 2007/0063; F02F 1/24; F02F 1/04
(Continued)

(56) References Cited

U.S. PATENT DOCUMENTS 1,376,620 A * 5/1921 Hildebrand ..... F02F 1/40 123/41.31
2,722,202 A * 11/1955 Emele ..... F02F 1/36 123/41.82 R
(Continued)

FOREIGN PATENT DOCUMENTS

CN 103797237 A 5/2014
CN 103867334 A 6/2014
(Continued)

OTHER PUBLICATIONS

International Preliminary Report on Patentability received for International Patent Application No. PCT/US2017/032694, dated Nov. 28, 2019, 7 pages.
International Search Report and Written Opinion issued by the ISA/US, Commissoner for Patents, dated Aug. 1, 2017, for International Patent Application No. PCT/US2017/032694, 7 pages.

*Primary Examiner* — Long T Tran
*Assistant Examiner* — James J Kim
(74) *Attorney, Agent, or Firm* — Faegre Drinker Biddle & Reath LLP

(57) ABSTRACT

A cylinder head [20, 120] mountable onto a cylinder block [16] of an engine [10] is disclosed. The cylinder head [20, 120] includes at least one fastener boss [28, 128] configured for receiving a fastener [24], and the cylinder head [20, 120] is securely fastened onto the cylinder block [16] of the engine [10] by the fastener [24]. A boss cutout [30, 130] is formed on a lower portion of the at least one fastener boss [28, 128] that abuts the cylinder block [16] such that a contact pressure balance of sealing pressures around the cylinder block [16] is evenly distributed.

20 Claims, 5 Drawing Sheets

(51) Int. Cl.
*F02F 1/24* (2006.01)
*F02F 11/00* (2006.01)

(58) Field of Classification Search
USPC ..... 123/193.5
See application file for complete search history.

(56) References Cited

U.S. PATENT DOCUMENTS

| | | | | |
|---|---|---|---|---|
| 2,851,020 | A | 9/1958 | Dolza | |
| 3,842,718 | A * | 10/1974 | Malchow | F02F 1/00 123/193.2 |
| 5,492,092 | A | 2/1996 | Benson | |
| 6,343,574 | B1 | 2/2002 | Leonard | |
| 8,950,374 | B2 | 2/2015 | Jones | |
| 9,470,177 | B2 | 10/2016 | Jones | |
| 9,562,494 | B2 | 2/2017 | Krenn | |
| 2008/0245334 | A1 | 10/2008 | Omura et al. | |
| 2013/0034070 | A1 | 2/2013 | Jones | |
| 2013/0340703 | A1 | 12/2013 | Jones et al. | |
| 2016/0003185 | A1 | 1/2016 | Krenn | |
| 2021/0332774 | A1 | 10/2021 | Chan et al. | |

FOREIGN PATENT DOCUMENTS

| | | | |
|---|---|---|---|
| CN | 105937441 | A | 9/2016 |
| DE | 4417480 | C1 | 5/1995 |
| DE | 102005026599 | A1 | 12/2006 |
| EP | 2746559 | A1 | 6/2014 |
| JP | 68-067944 | U | 5/1983 |
| JP | 10-009044 | A | 1/1998 |
| JP | 2000204918 | A | 7/2000 |
| JP | 2013245637 | A | 12/2013 |
| JP | 2015068318 | A | 4/2015 |
| WO | 2016113786 | A1 | 7/2016 |

* cited by examiner

CYLINDER HEAD BOLT BOSS CUTOUTS

CROSS-REFERENCE TO RELATED APPLICATIONS

The present application is a continuation and claims priority of U.S. patent application Ser. No. 16/614,223, filed on Nov. 15, 2019, which is a U.S. national stage under 35 U.S.C. § 371 of International Application No. PCT/US2017/032694, filed on May 15, 2017 titled "CYLINDER HEAD BOLT BOSS CUTOUTS," the entire disclosure of which is expressly incorporated herein in its entirety.

FIELD OF THE DISCLOSURE

The present disclosure generally relates to engine systems for internal combustion engines, and more specifically to cylinder heads that provide efficient sealing against corresponding portions of a liner and/or combustion chamber.

BACKGROUND OF THE DISCLOSURE

Internal combustion engines are available in a variety of different configurations. Some are spark-ignited wherein a mixture of air and fuel (e.g., gasoline) is delivered to each of the engine's cylinders and ignited at a specific time during the engine cycle to cause combustion. The combustion moves a piston in the cylinder, causing rotation of a crankshaft, which delivers power to a drivetrain. Other engines are compression-ignited wherein a mixture of air and fuel (e.g., diesel) is delivered to each of cylinder which combusts as a result of compression of the mixture in the cylinder during the compression stroke of the piston. Again, the combustion moves the piston, which causes rotation of the crankshaft, delivering power to the drivetrain.

Regardless of the ignition method, air is conventionally provided to the cylinders via intake valves connected to an intake manifold, and combustion by-products are removed via exhaust valves connected to an exhaust manifold. During combustion of the mixture of air and fuel in the cylinders, conventional cylinder heads often do not provide even sealing pressures at head gaskets disposed between corresponding heads and a cylinder block. The uneven sealing pressures at the head gaskets create unwanted engine degradation, causing performance reduction and engine life loss. Accordingly, it is desirable to develop a cylinder head that improves a contact pressure balance around the cylinder head to enhance the engine performance and durability of the engine.

SUMMARY OF THE DISCLOSURE

In one embodiment, the present disclosure provides a cylinder head mountable onto a cylinder block of an engine. The cylinder head includes at least one fastener boss configured for receiving a fastener, and the cylinder head is securely fastened onto the cylinder block of the engine by the fastener. A boss cutout is formed on a lower portion of the at least one fastener boss that abuts the cylinder block such that a contact pressure balance of sealing pressures around the cylinder block is evenly distributed.

In one aspect of this embodiment, the boss cutout has an inclined surface extending from an outermost periphery of a corresponding corner of the cylinder head toward a center of a bottom edge of an adjacent side wall of the cylinder head. The inclined surface is configured to generally follow a profile of the side wall and circumvent an obstruction disposed on the side wall or the corresponding corner. Further, a bottom circumference of the inclined surface of the boss cutout substantially follows a contour of a head gasket of the engine. The inclined surface has a substantially triangular shape when viewed from the side, and has a laterally flared lower portion, progressively widening toward a bottom of cylinder head.

In another aspect of this embodiment, another boss cutout is disposed on an opposite side of the cylinder head. A ratio between a boss cutout height of the boss cutout and a fastener spacing distance defined by space between centers of opposite fastener bosses is approximately 0.5. However, the ratio is variable based on a configuration of the cylinder head. In some embodiments, the ratio is greater than 0.5 or less than 0.5 based on a geometric configuration of the boss cutout. In some embodiments, the cylinder head has a substantially quadrilateral shaped body having four side walls.

In another embodiment of the present disclosure, a cylinder head is mountable onto a cylinder block of an engine. The cylinder head includes at least one fastener boss configured for receiving a fastener, and the cylinder head is securely fastened onto the cylinder block of the engine by the fastener. A boss cutout is formed on a lower portion of the at least one fastener boss that abuts the cylinder block such that a contact pressure balance of sealing pressures around the cylinder block is evenly distributed. A predetermined height of the boss cutout is less than a total height of the cylinder head.

In one aspect of this embodiment, the boss cutout has a concave surface defined by an inner diameter of the boss cutout. The concave surface of the boss cutout extends relative to a longitudinal axis of the boss cutout from a bottom edge of a side wall of the cylinder head by a predetermined height. A ratio between the inner diameter of the boss cutout and a head bolt spacing distance of the cylinder head is approximately 0.5. In one example, the ratio is variable based on a configuration of the at least one fastener boss. The configuration of the at least one fastener boss includes an inner diameter of the fastener boss. In another example, the ratio is variable based on a configuration of the boss cutout. The configuration of the boss cutout includes an inner diameter of the boss cutout. In some embodiments, the boss cutout has a plurality of sectional or irregularly surfaced walls. In some embodiments, the boss cutout of the cylinder head has a substantially cylindrical shape.

While multiple embodiments are disclosed, still other embodiments of the present disclosure will become apparent to those skilled in the art from the following detailed description, which shows and describes illustrative embodiments of the present disclosure. Accordingly, the drawings and detailed description are to be regarded as illustrative in nature and not restrictive.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

Figure 1:
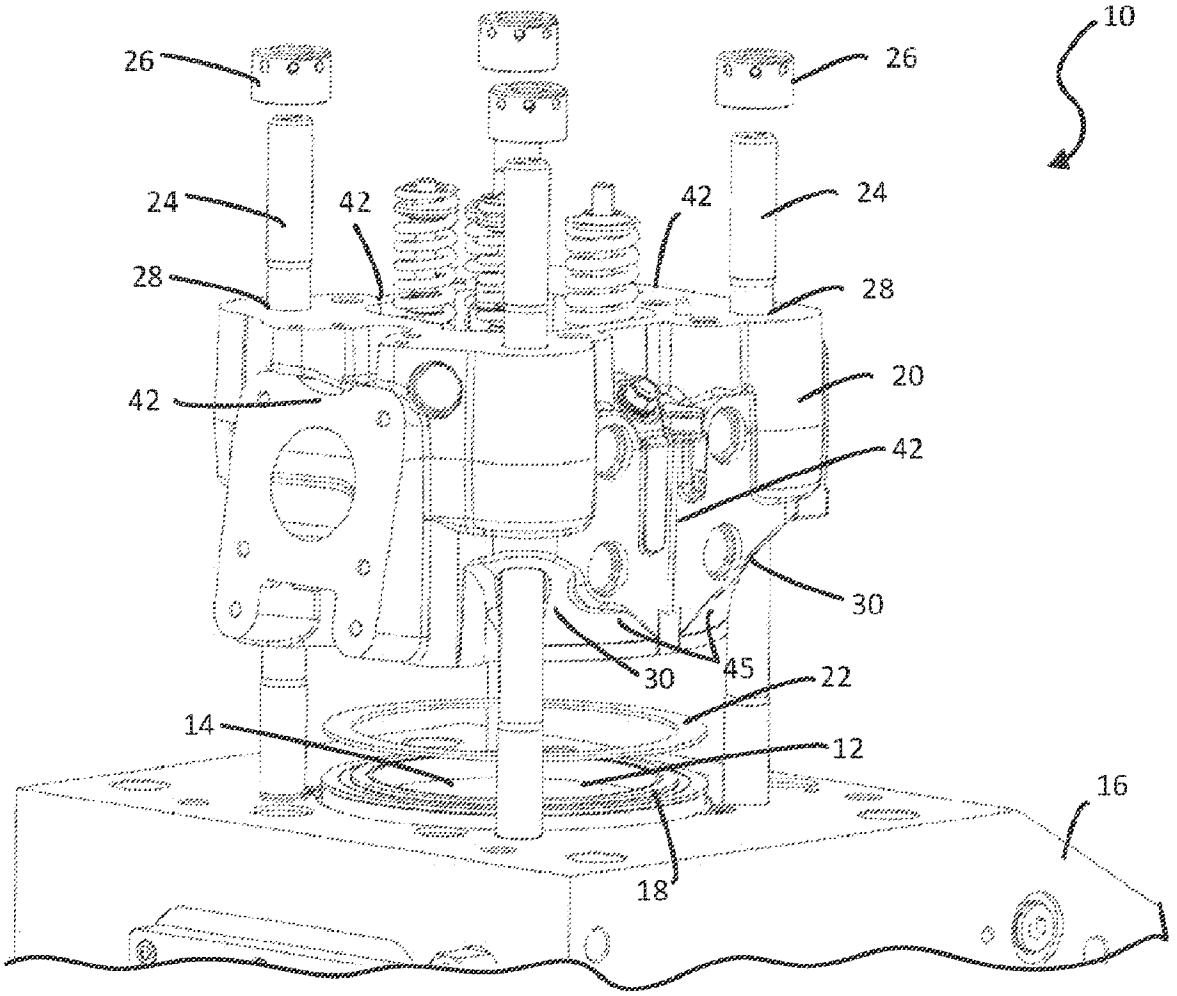
FIG. 1 is an exploded perspective view of a portion of an exemplary internal combustion engine, featuring a cylinder head in accordance with embodiments of the present disclosure.

While the present disclosure is amenable to various modifications and alternative forms, specific embodiments have been shown by way of example in the drawings and are described in detail below. The intention, however, is not to limit the present disclosure to the particular embodiments described. On the contrary, the present disclosure is intended to cover all modifications, equivalents, and alternatives falling within the scope of the present disclosure as defined by the appended claims.

DETAILED DESCRIPTION OF EMBODIMENTS

In the following detailed description, reference is made to the accompanying drawings which form a part hereof, and in which is shown by way of illustration specific embodiments in which the present disclosure is practiced. These embodiments are described in sufficient detail to enable those skilled in the art to practice the present disclosure, and it is to be understood that other embodiments can be utilized and that structural changes can be made without departing from the scope of the present disclosure. Therefore, the following detailed description is not to be taken in a limiting sense, and the scope of the present disclosure is defined by the appended claims and their equivalents.

Referring now to FIG. 1, a portion of a compression ignition (e.g., diesel) internal combustion engine 10 is shown. Engine 10 of embodiments of the present disclosure can be a four-cycle compression ignition engine employing direct injection of fuel, but other suitable types of engines are also contemplated. Engine 10 includes at least one cylinder cavity 12, which extends downward from an opening 14 defined by an upper surface of a cylinder block 16, and can be adapted to receive a removable cylinder liner 18. Engine 10 also includes at least one cylinder head 20 that attaches to cylinder block 16 to close cylinder cavity 12. A head gasket 22 is disposed or sandwiched between cylinder liner 18 (or cylinder block 16) and cylinder head 20. Each cylinder head 20 in engine 10 often has a substantially flat lower surface, and is mountable onto cylinder block 16 using fasteners 24 (e.g., bolts, studs, or rods) and nuts 26 through corresponding fastener bosses 28 so that sealing pressures are formed substantially around cylinder block 16. Each fastener boss 28 is configured to receive fastener 24 so that cylinder head 20 is securely fastened onto cylinder block 16 of engine 10 by each fastener 24.

One aspect of cylinder head 20 is that each fastener boss 28 includes a boss cutout 30 formed on a lower portion of fastener boss 28 that abuts cylinder block 16 such that a contact pressure balance of sealing pressures around cylinder block 16 is evenly distributed. Traditional cylinder heads without boss cutouts 30 create uneven sealing pressures around head gasket 22, and generate unwanted engine degradation, such as engine performance reduction and engine life loss. Gasket sealing pressures are typically highest around bolt bosses 28 of cylinder head 20. The disproportionately high gasket sealing pressure is a result of fastener bosses 28 transferring load generated by fasteners 24 directly to the lower portion of cylinder head 20. However, the cylinder head configuration shown in FIG. 1 provides even gasket sealing pressures that are generated by cylinder head 20 due to boss cutouts 30 formed on lower portions of corresponding fastener bosses 28. Formation of boss cutouts 30 enhances and promotes even distribution of gasket sealing pressures around head gasket 22. Detailed geometry modifications of cylinder head 20 are described below in paragraphs relating to FIGS. 2-6.

Figure 2:
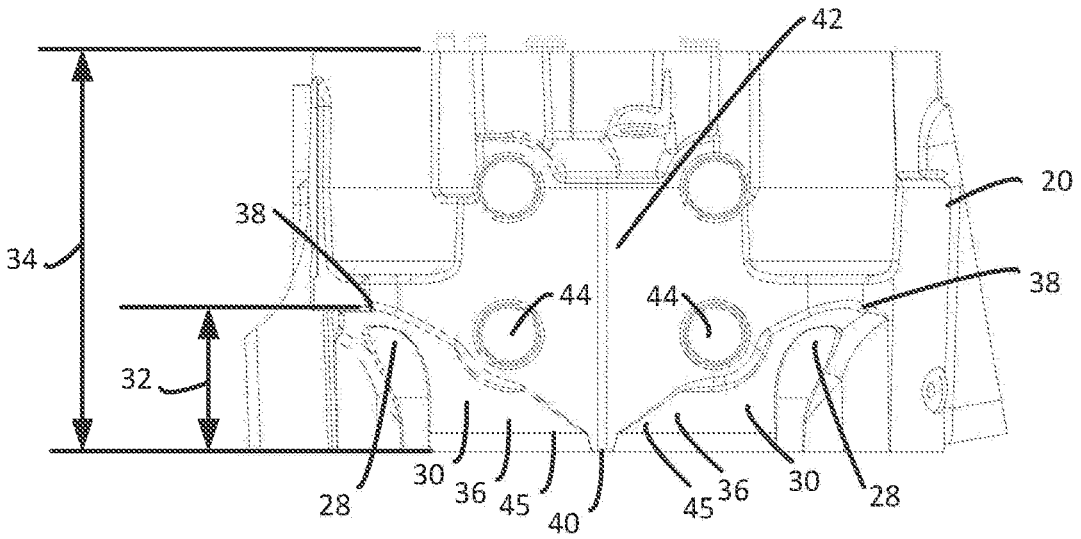
FIG. 2 is a side view of the cylinder head shown in FIG. 1 in accordance with embodiments of the present disclosure.
Figure 3:
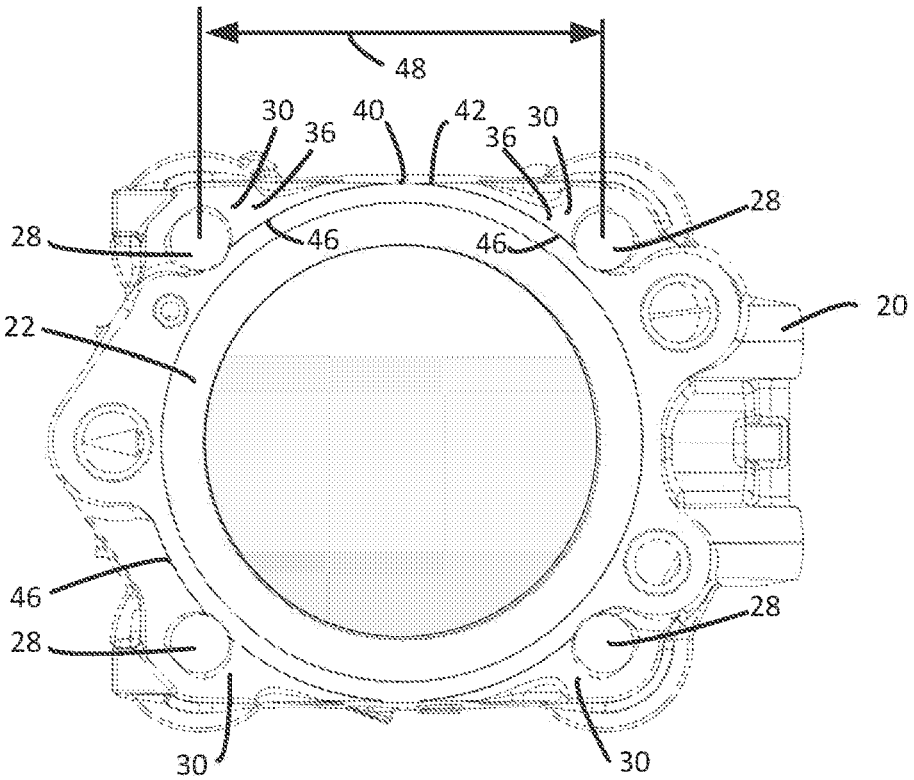
FIG. 3 is a bottom view of the cylinder head shown in FIG. 1 in accordance with embodiments of the present disclosure.

Referring now to FIGS. 2-3, each boss cutout 30 has a predetermined height 32 being less than a total height 34 of cylinder head 20, and has an inclined surface 36 extending substantially diagonally from an outermost periphery of a corresponding corner 38 of cylinder head 20 having boss cutout 30 toward a center 40 of a bottom edge of an adjacent side wall 42 of cylinder head 20. Although a substantially quadrilateral shaped body of cylinder head 20 having four side walls 42 is shown in FIG. 1, other suitable geometric shaped cylinders, such as cylindrical, hexagonal, triangular column shaped cylinders having multiple boss cutouts 30 are also contemplated to suit different applications.

Inclined surface 36 is configured to generally follow a profile of side wall 42 and circumvent any obstructions, such as plug holes 44 or bosses 28, disposed on side wall 42 or corresponding corner 38. In this example, inclined surface 36 has a substantially triangular shape when viewed from the side, and has a laterally flared lower portion 45 (see also FIG. 1), progressively widening toward a bottom of cylinder head 20. Further, as shown in FIG. 3, a bottom circumference 46 of inclined surface 36 of each boss cutout 30 substantially follows a contour of head gasket 22 to provide even sealing pressures around head gasket 22. In one example, configurations of two boss cutouts 30 disposed on opposite sides of cylinder head 20 are symmetrical. For example, another boss cutout 30 is symmetrically disposed on an opposite side of cylinder head 20. In another example, configurations of two boss cutouts 30 disposed on the opposite sides are asymmetrical to suit the application. For example, another boss cutout 30 is asymmetrically disposed on an opposite side of cylinder head 20.

An exemplary ratio $R_1$ between boss cutout height 32 and a fastener spacing distance 48 defined by space between centers of opposite fastener bosses 28 can be defined by expression (1):

$$R_1 = \frac{\text{Boss Cutout } Heigh}{\text{Spacing Distance}} \quad (1)$$

wherein Boss Cutout Height denotes boss cutout height 32 of boss cutout 30, and Spacing Distance denotes fastener spacing distance 48 between the centers of opposite fastener bosses 28.

In one example, the exemplary ratio $R_1$ is approximately 0.5, but other suitable ratios are contemplated to suit different applications. In some embodiments, the ratio $R_1$ is variable based on a configuration of cylinder head 20. For example, the ratio $R_1$ can be higher based on locations of plug holes 44 or other features present in cylinder head 20. In another example, a different geometric configuration of boss cutout 30 can redirect a load path in cylinder head 20 and necessitate a larger ratio $R_1$ greater than 0.5. It is also contemplated that the ratio $R_1$ can be less than 0.5 based on the geometric configuration of boss cutout 30 to suit different applications.

Figure 4:
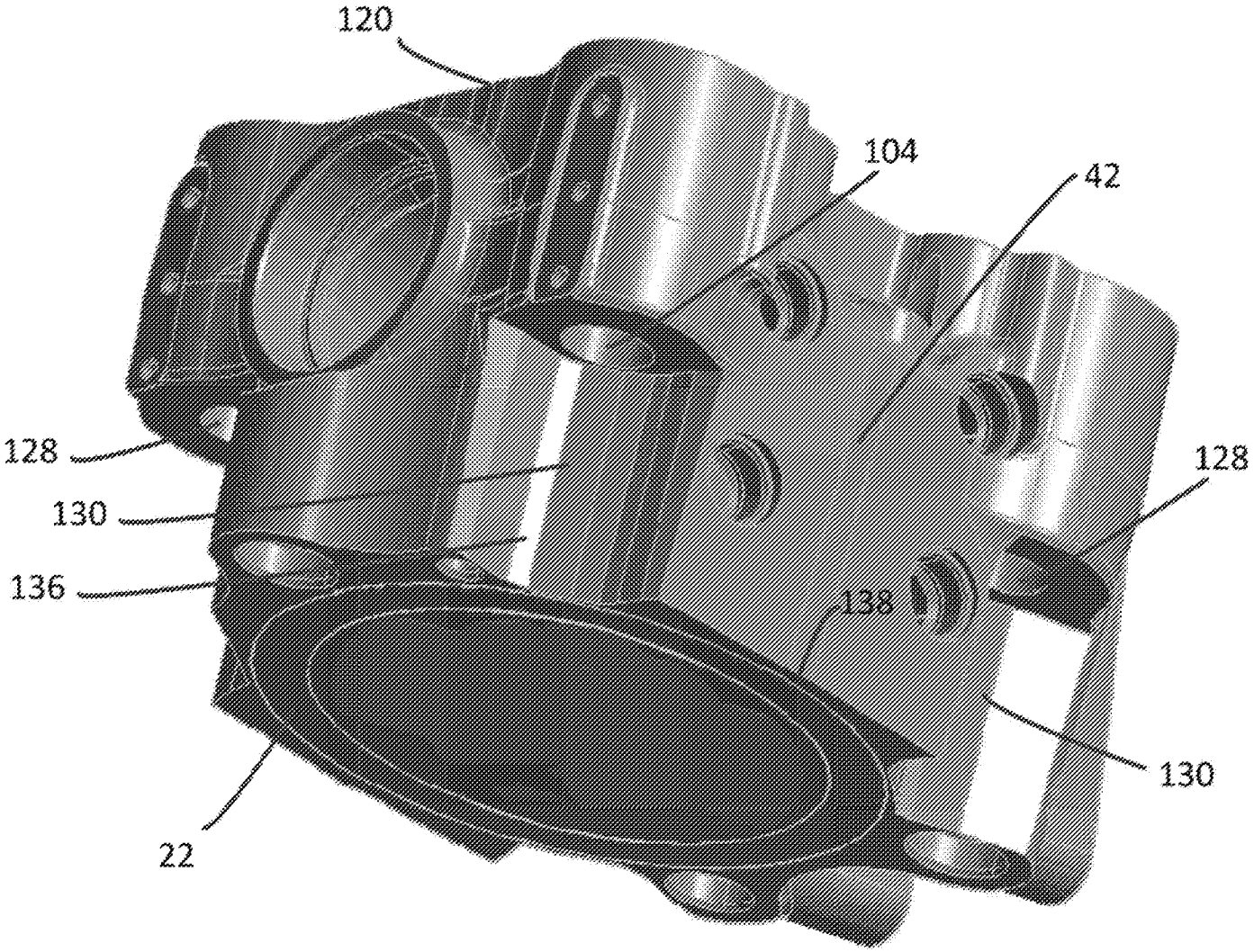
FIG. 4 is a perspective view of another cylinder head in accordance with embodiments of the present disclosure.
Figure 5:
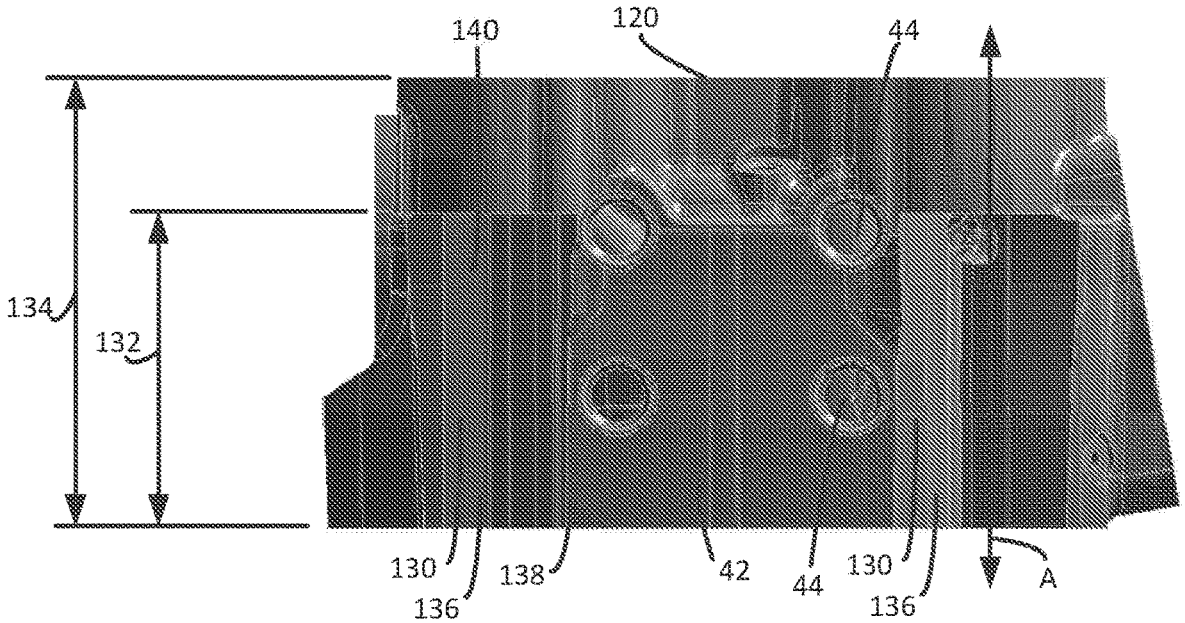
FIG. 5 is a side view of the cylinder head shown in FIG. 4 in accordance with embodiments of the present disclosure.
Figure 6:
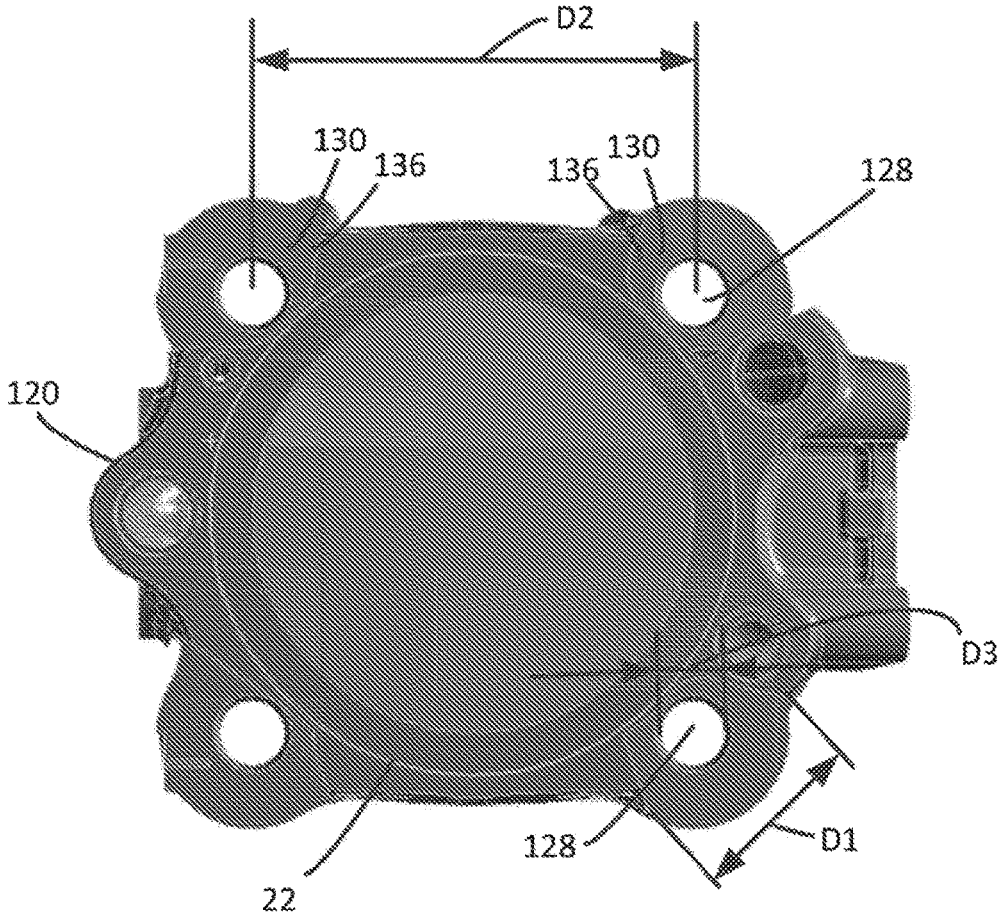
FIG. 6 is a bottom view of the cylinder head shown in FIG. 4 in accordance with embodiments of the present disclosure.

Referring now to FIGS. 4-6, another exemplary boss cutout 130 having a different geometric configuration is shown. Like reference numerals represent like components shown in FIGS. 1-3. In this example, a different type of cylinder head 120 has boss cutouts 130 formed on lower portions of corresponding fastener bosses 128. As with boss cutouts 30 discussed above, boss cutouts 130 enhance and promote even distribution of gasket sealing pressures around head gasket 22. However, rather than having inclined surface 36 of boss cutout 30, boss cutout 130 of cylinder head 120 has the different geometric configuration, e.g., a substantially cylindrical shape.

In this example, each boss cutout 130 has a predetermined height 132 being less than a total height 134 of cylinder head 120, and has a concave surface 136 defined by a predetermined diameter D1 (FIG. 6) of boss cutout 130. Concave surface 136 of each boss cutout 130 extends substantially vertically or relative to a longitudinal axis A of boss cutout 130 from a bottom edge 138 of side wall 42 of cylinder head 120 by the predetermined height 132. In one example, the predetermined height 132 is defined by a length that includes substantially all of plug holes 44 disposed on side wall 42.

An exemplary ratio $R_2$ between boss cutout diameter D1 and a head bolt spacing distance D2 (FIG. 6) can be defined by expression (2):

$$R_2 = \frac{\text{Boss Cutout Diameter}}{\text{Head Bolt Spacing Distance}} \quad (2)$$

wherein Boss Cutout Diameter denotes an inner diameter D1 of boss cutout 130, and Head Bolt Spacing Distance denotes a fastener spacing distance defined by space between centers of opposite fastener bosses 128. In one example, the exemplary ratio $R_2$ is approximately 0.5, but other suitable ratios are contemplated to suit different applications. In some embodiments, the ratio $R_2$ is variable based on a configuration of cylinder head 20, such as fastener boss 128 or boss cutout 130. For example, the ratio $R_2$ can be higher based on an inner diameter D3 of fastener boss 128 or other features present in cylinder head 120. In another example, a different geometric configuration of boss cutout 130, such as having sectional or irregularly surfaced walls 140, can redirect a load path in cylinder head 120 and necessitate a larger ratio $R_2$ greater than 0.5. It is also contemplated that the ratio $R_2$ can be less than 0.5 to suit different applications based on the geometric configuration of boss cutout 130.

Figure 7:
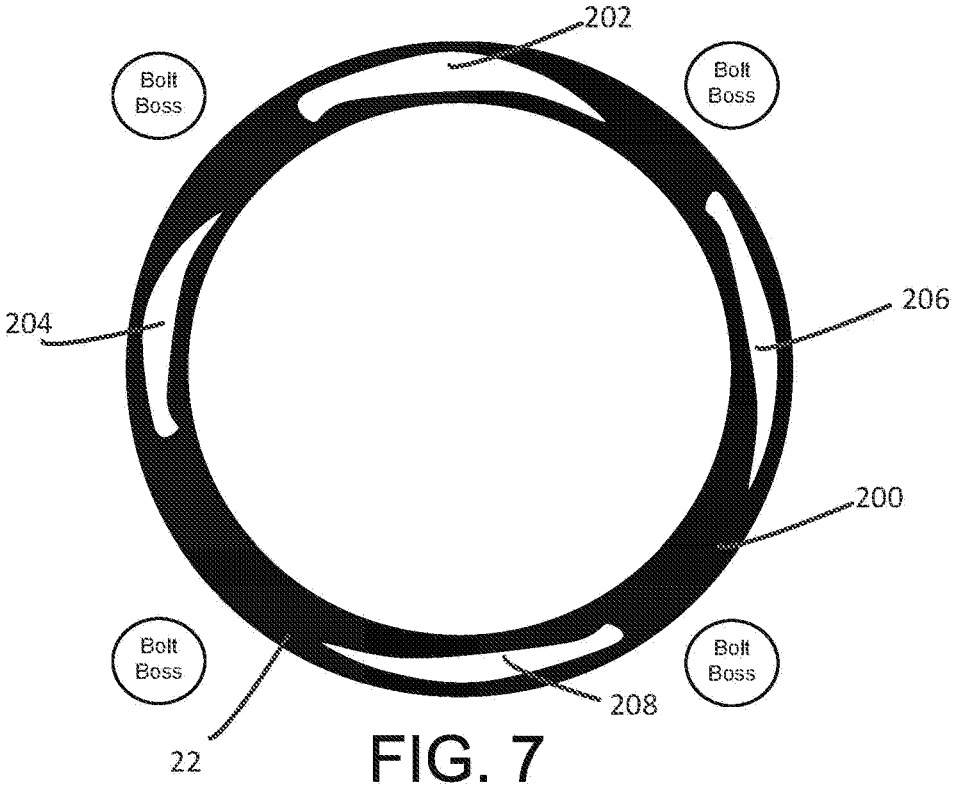
FIG. 7 is a pictorial illustration of a contact pressure balance generated by a conventional cylinder head mounted onto a cylinder block.

Referring now to FIG. 7, an exemplary illustrative effect of a contact pressure balance generated by a conventional cylinder head is shown. Shaded portions 200 of head gasket 22 represent regions that provide contact pressures greater than or equal to a predetermined threshold (e.g., in pascal (Pa)) around head gasket 22. In contrast, unshaded portions 202, 204, 206, 208 of head gasket 22 represent regions that provide contact pressures less than the predetermined threshold around head gasket 22. More specifically, an upper portion 202, a left portion 204, a right portion 206, and a lower portion 208 of head gasket 22 include regions having gasket sealing pressures less than the predetermined threshold.

Figure 8:
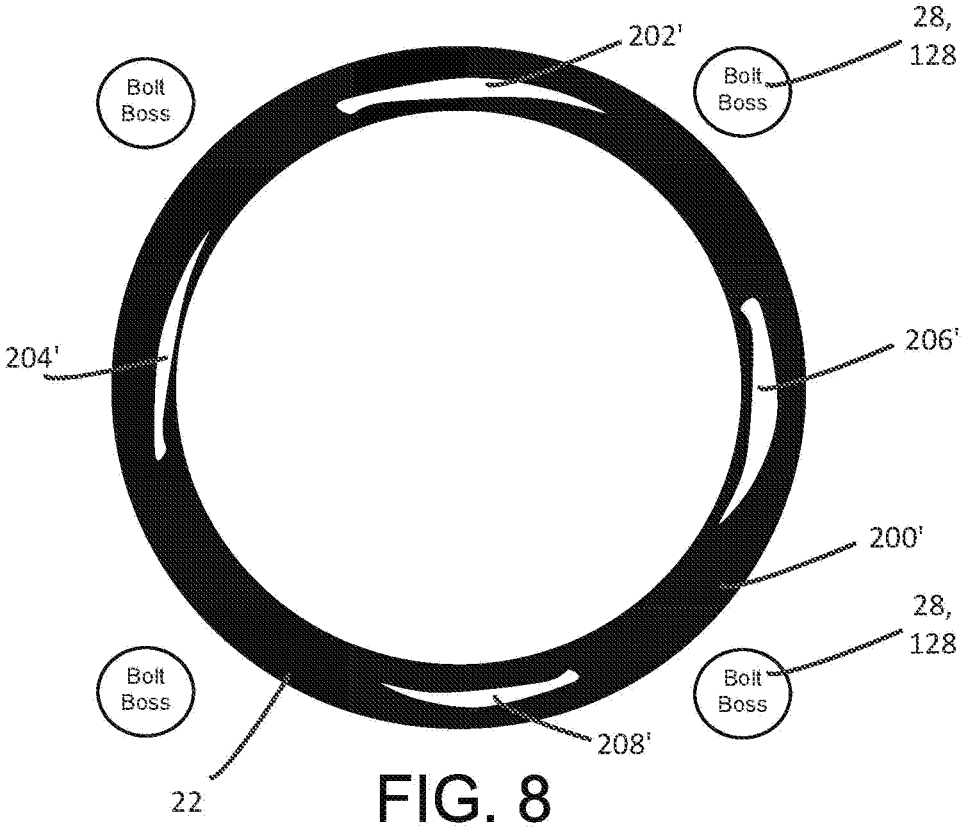
FIG. 8 is a pictorial illustration of a contact pressure balance generated by the cylinder head shown in FIG. 1 or FIG. 4.

Referring now to FIG. 8, an exemplary illustrative effect of the contact pressure balance generated by present cylinder head 20 or 120 is shown. Due to the specific configurations of boss cutouts 30, 130 shown in FIGS. 1 and 4, respectively, the gasket sealing pressures are substantially improved in unshaded portions 202', 204', 206', 208' of head gasket 22. Specifically, when compared to unshaded portions 202, 204, 206, 208 shown in FIG. 7, corresponding upper portion 202', left portion 204', right portion 206', and lower portion 208' include much smaller unshaded regions. Thus, it has been discovered that cylinder heads 20, 120 having boss cutouts 30, 130 improve the contact pressure balance around cylinder heads and enhance the engine performance and durability of engine 10.

It is to be understood that the above description is intended to be illustrative, and not restrictive. Many other embodiments will be apparent to those of skill in the art upon reading and understanding the above description. For example, it is contemplated that features described in association with one embodiment are optionally employed in addition or as an alternative to features described in associate with another embodiment. The scope of the present disclosure should, therefore, be determined with reference to the appended claims, along with the full scope of equivalents to which such claims are entitled.

What is claimed is:

1. A cylinder head mountable onto a cylinder block of an engine, the cylinder head comprising:

at least one fastener boss configured for receiving a fastener wherein the cylinder head is securely fastened onto the cylinder block of the engine by the fastener;

the at least one fastener boss including:

a lower portion that abuts the cylinder block of the engine when the cylinder head is securely fastened onto the cylinder block by the fastener, the lower portion including a lower surface that abuts the cylinder block and forms a bottom edge at an outermost periphery of the cylinder head; and a boss cutout formed at the lower portion of the at least one fastener boss and extending from the outermost periphery of a corresponding corner of the cylinder head toward a center of a bottom edge of an adjacent side wall of the cylinder head such that a contact pressure balance of sealing pressures around the cylinder block is evenly distributed.

2. The cylinder head of claim 1, wherein the boss cutout has an inclined surface extending from the outermost periphery of the corresponding corner of the cylinder head toward the center of the bottom edge of the adjacent side wall of the cylinder head.

3. The cylinder head of claim 2, wherein the inclined surface is configured to generally follow a profile of the side wall and circumvent an obstruction disposed on the side wall or the corresponding corner.

4. The cylinder head of claim 2, wherein a bottom circumference of the inclined surface of the boss cutout substantially follows a contour of a head gasket of the engine.

5. The cylinder head of claim 2, wherein the inclined surface has a substantially triangular shape when viewed from the side, and has a laterally flared lower portion, progressively widening toward the bottom edge of the cylinder head.

6. The cylinder head of claim 1, wherein another boss cutout is disposed on an opposite side of the cylinder head.

7. The cylinder head of claim 1, wherein the at least one fastener boss includes at least two opposite fastener bosses, and wherein a ratio between a boss cutout height of the boss cutout and a fastener spacing distance defined by space between centers of the opposite fastener bosses is approximately 0.5.

8. The cylinder head of claim 7, wherein the ratio is variable based on a configuration of the cylinder head.

9. The cylinder head of claim 1, wherein the cylinder head has a substantially quadrilateral shaped body having four side walls.

10. A cylinder head mountable onto a cylinder block of an engine, the cylinder head comprising:

at least one fastener boss configured for receiving a fastener wherein the cylinder head is securely fastened onto the cylinder block of the engine by the fastener;

the at least one fastener boss including:

a lower portion that abuts the cylinder block of the engine when the cylinder head is securely fastened onto the cylinder block by the fastener, the lower portion including a lower surface that abuts the cylinder head and forms a bottom edge at an outermost periphery of the cylinder head; and a boss cutout having a substantially cylindrical shape formed at the lower portion of the at least one fastener boss and extending from the outermost periphery of a corresponding corner of the cylinder head toward a center of a bottom edge of an adjacent side wall of the cylinder head such that a contact pressure balance of sealing pressures around the cylinder block is evenly distributed.

11. The cylinder head of claim 10, wherein the boss cutout has a concave surface defined by an inner diameter of the boss cutout.

12. The cylinder head of claim 11, wherein the concave surface of the boss cutout extends relative to a longitudinal axis of the boss cutout from a bottom edge of a side wall of the cylinder head by a predetermined height.

13. The cylinder head of claim 1, wherein a ratio between an inner diameter of the boss cutout and a head bolt spacing distance of the cylinder head is approximately 0.5.

14. The cylinder head of claim 13, wherein the ratio is variable based on a configuration of the at least one fastener boss.

15. The cylinder head of claim 14, wherein the configuration of the at least one fastener boss includes the inner diameter of the at least one fastener boss.

16. The cylinder head of claim 15, wherein the ratio is variable based on a configuration of the boss cutout.

17. The cylinder head of claim 16, wherein the configuration of the boss cutout includes the inner diameter of the boss cutout.

18. The cylinder head of claim 10, wherein the boss cutout has a plurality of sectional or irregularly surfaced walls.

19. The cylinder head of claim 1, wherein the boss cutout forms an innermost exterior surface of the at least one fastener boss at the bottom edge of the cylinder head.

20. The cylinder head of claim 10, wherein the substantially cylindrical shape extends axially along a height of the cylinder head.

* * * * *